US010208512B1

(12) United States Patent
Arthurs et al.

(10) Patent No.: US 10,208,512 B1
(45) Date of Patent: Feb. 19, 2019

(54) LATCH AND RELEASE MECHANISMS FOR WASTE CONTAINERS

(71) Applicant: The Eastern Company, Cleveland, OH (US)

(72) Inventors: Scott Arthurs, Brunswick, OH (US); Lee S. Weinerman, Medina, OH (US); Keith A. Braun, Brunswick, OH (US); Richard Jelen, Grafton, OH (US)

(73) Assignee: THE EASTERN COMPANY, Cleveland, OH (US)

( * ) Notice: Subject to any disclaimer, the term of this patent is extended or adjusted under 35 U.S.C. 154(b) by 971 days.

(21) Appl. No.: 14/695,570

(22) Filed: Apr. 24, 2015

Related U.S. Application Data

(60) Provisional application No. 62/081,365, filed on Nov. 18, 2014, provisional application No. 61/984,428, filed on Apr. 25, 2014, provisional application No. 61/984,464, filed on Apr. 25, 2014.

(51) Int. Cl.
*E05B 65/52* (2006.01)
*B65F 1/16* (2006.01)
(Continued)

(52) U.S. Cl.
CPC ..... *E05B 65/5292* (2013.01); *B65F 1/1615* (2013.01); *B65F 1/1623* (2013.01);
(Continued)

(58) Field of Classification Search
CPC ..... B65F 1/1615; B65F 1/1623; B65F 1/16; B65F 2001/1669; E05F 1/02; E05C 19/009; E05B 1/0092; E05B 15/006; E05B 15/0093; E05B 65/5292; E05B 17/0041; E05B 17/2011; E05B 63/121; Y10S 292/22; Y10T 292/1023; Y10T 292/0803;
(Continued)

(56) References Cited

U.S. PATENT DOCUMENTS 4,155,584 A * 5/1979 Pracchia ..... B65F 1/1615 294/68.1
5,224,744 A * 7/1993 Michelutti ..... B65F 1/1615 220/908
(Continued)

FOREIGN PATENT DOCUMENTS

DE 19709209 A1 * 9/1998 ..... B65F 1/1615
DE 19833882 A1 * 2/2000 ..... B65F 1/1615
(Continued)

*Primary Examiner* — Christine M Mills
(74) *Attorney, Agent, or Firm* — Ralph E. Jocke; Walker & Jocke

(57) ABSTRACT

A latch is provided for latching and automatically unlatching a lid from a waste container. The latch mechanism includes a release weight that moves responsive to gravity in a housing from a first position to a second position to cause the latch to disengage from a striker when the latch is rotated to a dump angular orientation. The latch includes a damper that controls movement of the release weight in the housing such that an amount of time for the release weight to move responsive to gravity from the first position to the second position is at least two times an amount of time the release weight would take to move responsive to gravity from the first position to the second position absent the effect of the damper.

20 Claims, 10 Drawing Sheets

(51) Int. Cl.

| | |
|---|---|
| ***E05B 15/00*** | (2006.01) |
| ***E05F 1/02*** | (2006.01) |
| ***E05B 63/12*** | (2006.01) |
| ***E05C 19/00*** | (2006.01) |

(52) U.S. Cl.
CPC ..... *E05B 15/006* (2013.01); *E05B 15/0093* (2013.01); *E05B 63/121* (2013.01); *E05C 19/009* (2013.01); *E05F 1/02* (2013.01); *B65F 2001/1669* (2013.01); *Y10S 292/22* (2013.01)

(58) Field of Classification Search
CPC ..... Y10T 292/0806; Y10T 292/0844; Y10T 292/1006; Y10T 292/1011; Y10T 292/102; Y10T 292/1063; Y10T 292/14; Y10T 292/57
USPC ..... 292/146, 5, 7, 40, 183, 188, 143, 230, 292/252, 336.3, DIG. 22
See application file for complete search history.

(56) References Cited

U.S. PATENT DOCUMENTS

| | | | | |
|---|---|---|---|---|
| 6,666,485 | B1 * | 12/2003 | Moret | B65F 1/1615 220/315 |
| 6,733,049 | B2 * | 5/2004 | Piorkowski | B64C 1/1469 292/139 |
| 9,260,891 | B2 * | 2/2016 | Treadwell | E05B 65/5292 |
| 9,856,058 | B1 * | 1/2018 | Arthurs | B65D 45/02 |
| 2016/0060898 | A1 * | 3/2016 | Michael | E05B 15/0093 292/200 |
| 2016/0200509 | A1 * | 7/2016 | Matuschek | E05C 3/124 292/242 |
| 2017/0043950 | A1 * | 2/2017 | Reeb | E05B 65/5292 |

FOREIGN PATENT DOCUMENTS

| | | | | |
|---|---|---|---|---|
| EP | 1396446 | A1 * | 3/2004 | G65F 1/1615 |
| FR | 2802965 | A1 * | 6/2001 | B65F 1/1615 |

* cited by examiner

LATCH AND RELEASE MECHANISMS FOR WASTE CONTAINERS

CROSS REFERENCE TO RELATED APPLICATIONS

This application claims benefit pursuant to 35 U.S.C. § 119(e) of Provisional Application Nos. 61/984,428 filed Apr. 25, 2014, 61/984,464 filed Apr. 25, 2014 and 62/081,365 filed Nov. 18, 2014, the disclosures of each of which are incorporated herein by reference in its entirety.

TECHNICAL FIELD

Exemplary embodiments relate to mechanical latches that selectively hold items in engagement and release such items from engagement. Exemplary embodiments further relate to latches used to selectively hold and release lids or covers of waste containers.

BACKGROUND

Waste containers are mechanical devices that are typically used to hold discarded items. An example of a waste container includes a trash can or bin that is typically used to temporarily store garbage or other waste items. Waste containers often have lids that help hold and isolate the contents of the waste container. For example, lids can prevent the contents of waste containers from being exposed to wind, rain and snow. Lids can contain undesirable odors of the contents. Lids can also prevent the contents of waste containers from being accessed by domestic and wild animals scavenging for food.

To avoid a lid from being opened at inappropriate times, the lid and/or the bin of the waste container to which the lid is attached may include a latch mechanism. Such latch mechanisms for waste containers may benefit from improvements.

SUMMARY

The following is a brief summary of subject matter that is described in greater detail herein. This summary is not intended to be limiting as to the scope of the claims.

In one example embodiment, a latch mechanism may be configured to be mounted to a bin of a waste container that includes a lid. Such a bin of a waste container includes walls that bound an interior space or cavity and an opening into the interior space, which is coverable by the lid. Such a lid may be attached to the bin via a hinge or other pivoting connection such that the lid is operative to pivot with respect to the bin between an open position and a closed position relative to the opening into the interior cavity.

When the lid is in the closed position, the lid includes an inside surface facing the interior cavity and the lid includes an opposed outside surface. In the examples described herein, the latch mechanism may be in operative connection with either the lid and/or the bin of waste container. In an example embodiment, the latch mechanism is in operative connection with the inside surface of the lid and a striker may be in operative connection with an inside wall surface of the bin. The latch mechanism may automatically engage with the striker in order to lock the lid in the closed position relative to the bin. However, it should be appreciated that in alternative embodiments, the latch mechanism and striker may be located in different locations. For example, the latch mechanism could be in operative connection with the wall of the bin and be operative to engage with a striker or other device in operative connection with the lid.

In order to open the lid, the bin may include one or more release mechanisms. Such mechanisms may be configured to be manually operated by a human in order to enable the latch mechanism the striker to disengage and enable the lid to pivot to its open position. However, it should also be appreciated that in some applications, the waste container may also be configured to enable the latch mechanism to disengage and the lid to automatically open without direct manual intervention.

For example, waste carrier providers may employ a lifting mechanism to lift and rotate a waste container over a trash receiving receptacle of a garbage truck. To avoid the latched lid from preventing the contents of the waste container from being dumped out of the container and into the receptacle of the garbage truck, the latch mechanism may be configured to automatically disengage from the striker and permit the lid to rotate to an open position. In such an embodiment, the latch mechanism may be configured such that in certain predetermined angular orientations of the latch mechanism, gravity is operative to actuate portions of the latch mechanism to enable the latch mechanism to disengage from the striker.

In an exemplary arrangement, both the hand operated release features and the automatic release features of the latch mechanism are capable of maintaining a lid in a closed position when the waste container is in an upright position and a human is not engaging the release mechanism. However, some animals (such as raccoons) working individually or in groups may be capable of discovering methods of opening a lid of a waste container in order to access discarded food therein. Thus, example embodiments of the latch mechanisms and release mechanisms described herein may be configured to require specific actions to operate that are not capable of being discovered and/or carried out by most raccoons.

For example, raccoons working together may be capable of pushing/pulling a waste container on its side, which causes the waste container and latch mechanism to rotate 90 degrees. Thus, to prevent the lid from opening in this possible situation, an example embodiment of a latch mechanism may be operative to prevent the lid from opening automatically unless the waste container and latch mechanism has rotated from the upright position to a range of predetermined angles that is greater than 90 degrees. A dumping mechanism of a garbage truck may lift and rotate the waste container between 120 and 180 degrees from the upright position. Thus the exemplary described latch mechanism would be operative to automatically disengage the latch and enable the lid to open so the container can be dumped into a truck. However, on flat ground, a raccoon is much less likely to be able to rotate a waste container more than 90 degrees by tipping it over. Thus, the lid would remain shut when tipped over by a raccoon or other animal.

It should also be appreciated that aggressively tipping over a waste receptacle at only 90 degrees could impart a sufficient amount of kinetic energy, jarring, momentum, and/or centrifugal forces to internal parts of the latch mechanism to mimic the effect that gravity would have on the internal parts of a latch mechanism for a waste container when the container is rotated by more than 90 degrees from the upright position. Thus, to prevent the lid from opening in this possible situation, an example embodiment of a latch mechanism may be operative to prevent the lid from opening unless the waste container and latch mechanism has rotated into the range of the larger angular displacement (e.g., the opening of the bin more than 90 degrees from horizontal) for more than a set period of time, such as more than a couple of seconds. Such a delay is operative to provide time for the initial short term jarring effects of the fallen waste container to dissipate without the latch opening, so that only the angular orientation of the waste container and latch mechanism to within the predetermined angular range from upright (e.g., more than 90 degrees) for longer than the delay period causes the latch mechanism to disengage and cause the lid of the waste container to open.

An example latch mechanism that is operative in this described manner may include an engagement mechanism that is operable to engage with a striker. The latch mechanism may also include a housing. In addition, the latch mechanism may include a release weight that is operable to move responsive to gravity within the housing between a first position and a second position. When moving from the first position to the second position, the release weight is operative to cause the engagement mechanism to disengage from the striker when the latch mechanism is in a predetermined range of angular orientations. Such a predetermined range of angular orientations for example, may include a rotation of an upright waste container by more than 90 degrees from an initial upright orientation such that the container opening is directed at least somewhat downward to enable dumping the contents of the container.

The exemplary latch mechanism may be configured to prevent the release weight from enabling the engagement mechanism to disengage from the striker, in a range of angular orientations of the latch mechanism that is more than 90 degrees from the normal upright position in any direction (e.g., clockwise, counterclockwise, and sideways). For example, the threshold angular orientation from when the latch mechanism changes from a state of not enabling the engagement mechanism to disengage from the striker to a state of causing the engagement mechanism to disengage from the striker may be configured to be at between 90-95 degrees in one embodiment, at between 95-100 in another embodiment, at between 100-110 degrees in another embodiment, at between 110-120 degrees in a further embodiment, or any other angle or range of angles that are all greater than 90 degrees.

In an example embodiment, the latch mechanism may include a damper. Such a damper is operative to limit the speed of movement of the release weight in the housing. In an example configuration the amount of time required for the release weight to move responsive to the force of gravity from the first position to the second position is at least twice the amount of time it would take the release weight to move responsive to gravity from the first position to the second position in the housing absent the effect of the damper on the release weight. Such a damper for example may correspond to a rotary damper (e.g. one in which fluid damping is provided by a resistant shearing force of a fluid between a stator and rotor). Such a damper may be configured to slow the angular velocity of the release weight in the housing of the latch mechanism. However, in other embodiments other types of dampers may be used (e.g., viscous fluids adjacent the release weight, torsion springs, gears, etc.) that are operative to substantially slow or otherwise control the movement of speed of the release weight.

In an example embodiment, the engagement mechanism may include a latch shaft. Such a latch shaft may be configured to extend into an aperture of a striker to become releasably engaged therein. The exemplary latch shaft may include an annular wall and an axially extending cavity therein. The latch shaft may also have movable projecting members (e.g. such as metal balls, spheres, vanes, fingers, etc.) in operative connection therewith. The projecting members are operative to move between retracted positions and extended positions radially with respect to the annular wall. For example, in the extended positions, portions of metal balls positioned in the cavity may extend radially from the latch shaft outwardly through apertures in the annular wall of the latch shaft. Such balls when extended may prevent the latch shaft from being pulled out of a cooperative aperture or other engagement structure in the striker.

In order to disengage the latch shaft from the striker, the latch mechanism may further include a latch pin. Portions of the latch pin may movably extend in the axial cavity in the latch shaft. Also, the latch pin may be operable to move between a retracted position and an extended position, such that in the extended position the latch pin extends relatively further inside the cavity of the latch shaft compared to the retracted position. The latch pin may include channels in one or more walls thereof. Depending on the relative location of the channels in the latch shaft, the metal balls or other projecting members may be urged by the outside walls of the latch pin to the extended positions (such as when the balls or other projecting members are not aligned with the channels in the walls of the latch pin) or may be enabled to move radially inward to their retracted positions by sliding inward in the channels (when the balls or other members are aligned with the channels).

The exemplary latch mechanism may also include a release lever in operative connection with the latch pin. When the release weight moves to the second position of the release weight, due to gravitational force resulting from a change in vertical orientation of the latch, the release weight is operative to engage the release lever and cause the release lever to rotate. Rotation of the release lever urges the latch pin to axially move in the cavity of the latch shaft from a first (retracted) position to a second (extended) position relative to the latch shaft. In the first (retracted) position of the latch pin, the channels in the outer wall of the latch pin are not aligned with the projecting members such as the plurality of balls. However, in the second (extended) position of the latch pin, the channels of the latch pin are aligned with the balls, such that the balls are enabled to move radially inward relative to the latch shaft from their extended positions, to their retracted positions and enable the latch mechanism and the striker to disengage.

In this described example, the latch mechanism may further include a spring in operative connection with the latch pin. When the release weight moves from the second position back to the first position of the release weight, the weight no longer acts on the release lever and the spring is operative to bias the latch pin and causes it to move from the second (extended) position to the first (retracted) position of the latch pin. Such movement causes the channels in the wall of the latch pin to move axially away from the location of the balls. Thus the outer walls of the latch pin are operative to urge the balls to their radially extended positions (to enable locking engagement with the striker).

It should also be noted that animals such as raccoons may be capable through trial and error of discovering ways to operate simple buttons or handles in order to manually open certainly previously known latch mechanisms of a waste container. To reduce the risk of animals opening example embodiments of the waste containers described herein, such containers may employ a release mechanism that requires a combination of different manual operations to manually cause the latch mechanism to disengage from the striker (when the waste container is in its normal upright—0 degree position).

For example, an embodiment of the release mechanism may include a movable release knob that requires the knob to be both pushed inwardly and then rotated in order to release the latch mechanism. In this example, the release mechanism may further include a release base and a latch pin. This release mechanism may be mounted to an outside surface of the lid in a location such that the release pin is operative to extend through an aperture in the lid and be aligned with a portion of the previously described latch lever of the latch mechanism.

The release knob is enabled to be moved between an extended position and a retracted position relative to the release base. Also, a spring may bias the release knob to move to the outward extended position. When the release knob is in the retracted position, the release knob is enabled to be rotated with respect to the release base in a rotational direction. A further spring may bias the release knob in the opposite rotational direction.

In this described example, the release knob may include a cam surface. When the release knob is in the retracted position and is rotated in a first rotational direction, the cam surface is operative to urge the release pin to move from a retracted position relative to the release base to an extended position relative to the release base. As the pin moves to the extended position, it is operative to urge the release lever to rotate and urge the latch pin to axially move in the cavity of the latch shaft from a first (retracted) position to a second (extended) position relative to the latch shaft (so as to align the channels in the walls of the latch pin with the balls or other projecting members and to enable the latch mechanism to disengage from the striker).

Other aspects of example embodiments will be appreciated from reading and understanding the figures and detailed description herein.

DETAILED DESCRIPTION

Figure 1:
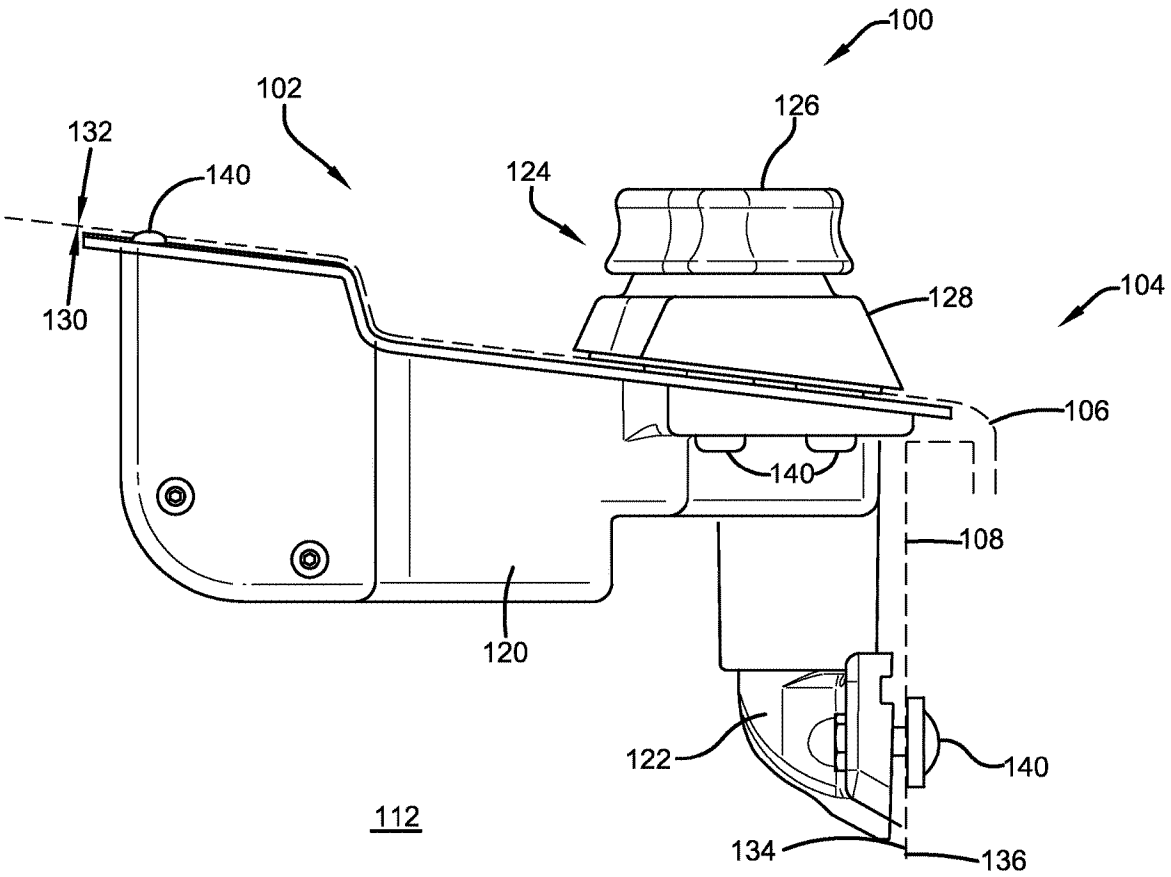
FIG. 1 is a side view of an exemplary latch apparatus that facilitates latching and unlatching a lid on a bin of a waste container.

Various technologies pertaining to latch and release mechanisms for waste containers will now be described with reference to the drawings, where like reference numerals represent like elements throughout. In addition, the example systems are illustrated and described herein for purposes of explanation; however, it is to be understood that functionality that is described as being carried out by certain system components may be performed by multiple components. Similarly, for instance, a component may be configured to perform functionality that is described as being carried out by multiple components.

FIG. 1 is a side view 100 of an example apparatus 102 that enables latching and unlatching a cover, which is alternatively referred to herein as a lid, to a bin of a waste container 104. Such a lid 106 may for example be in pivoting connection with the bin 108 of the waste container via one or more hinges (not shown). The lid may pivot from the closed position shown in FIG. 1 to an open position in which an opening to a cavity 112 bounded by walls of the bin is accessible to load or unload articles (e.g., garbage/trash) to or from the cavity. Some elements of the hinge may be formed integral with the lid and/or bin of the waste container. However, it should be appreciated that in some embodiments separate hinge components may be fastened to the lid and/or bin of the waste container to enable the lid and bin to pivot with respect to each other.

In an example embodiment, the lid and bin of the and waste container may be made of a plastic material such as a high density polyethylene (or other plastic such as a polypropylene) via a manufacturing process such as blow molding, injection molding, or other molding process. However, it should be appreciated that in alternative embodiments, the lid and bin of the waste container may be made out of other materials such as metal (e.g., aluminum or steel). Alternatively in some example embodiments some components of the waste container may be plastic and some may be metal.

Figure 2:
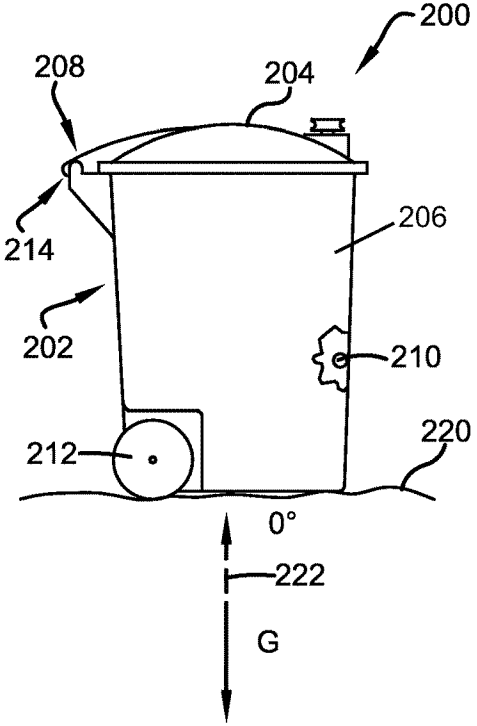

FIG. 2 is a side view 200 of an exemplary waste container 202 having a lid 204 and a bin 206, which is usable with the exemplary latch mechanisms described herein. The lid and bin may be coupled in relatively movable relation via integral hinge portions 208. In FIG. 2, the waste container is shown in an upright vertical orientation 222 relative to the ground 220. In this orientation the direction of gravitational force G is shown with the opening to the internal cavity of the bin extending generally horizontal. The lid 204 is in a closed position closing the opening facing upwardly. This upright orientation 222 corresponds to the waste container being rotated 0 degrees (i.e., it is not rotated from this upright position). The upright orientation of the container corresponds to the usual orientation of the container when the lid is opened for purposes of material being added to the cavity and when the container is holding material with the lid closed.

The exemplary waste container 202 includes features that enable the waste container to be lifted, rotated and unloaded using a lifting mechanism of a garbage truck or other unloading device. Such features for example may include a metal horizontal retention bar 210 operatively coupled to exterior walls of the bin in a recess bounded by such walls (shown partially cut-away in FIG. 2 for illustrative purposes). Such a waste container 202 may also include wheels 212 and a handle 214. In the U.S., such waste containers may be compatible with a published standard such as ANSI Z245.60-2008, which is incorporated herein by reference. Also, such waste containers may have different interior capacities such as 26 gallon, 32 gallon, 64 gallon, or 96 gallon sizes, or other waste container sizes. Thus, it should be appreciated that example embodiments of the latches and release components described herein may be adapted for use with any type and/or configuration of a waste container that includes a lid.

Figure 4:
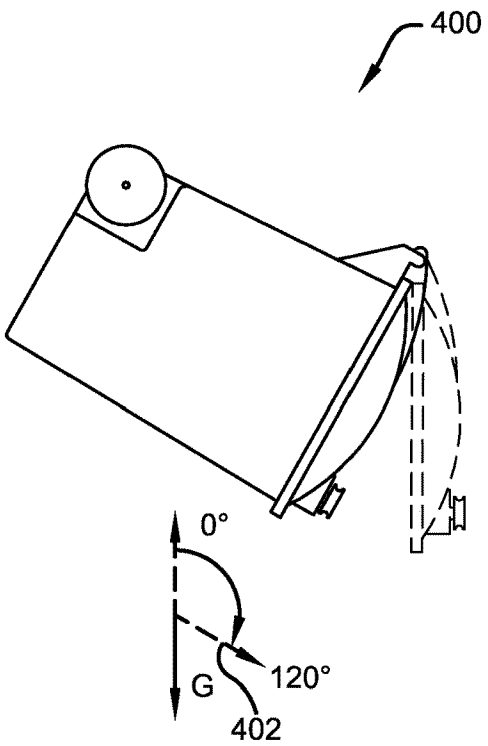
FIGS. 2-4 are side views of a waste container in different rotational positions.
Figure 3:
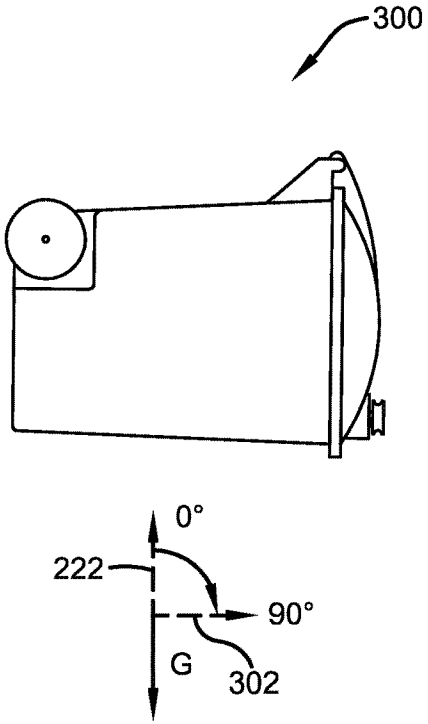

FIGS. 3 and 4 show the waste container in different angular orientations as it is being lifted and rotated by an exemplary lifting and unloading mechanism (however, the lifting and unloading mechanism is not shown). In particular, FIG. 3 illustrates an example side view 300 of the waste container 202 in a rotated orientation relative to the direction of gravitation force G with the bin opening and the closed lid 204 facing sideways. This sideways orientation 302 corresponds to the waste container being rotated 90 degrees from the upright orientation 222 shown in FIG. 2.

FIG. 4 is a side view 400 of the exemplary waste container 202 in a further rotated orientation relative to the gravitation force G with the lid being enabled to rotate relative to the bin responsive to gravity. In this orientation the lid is movable from its closed position to expose the opening to the cavity. This downwardly angled orientation corresponds to the waste container being angularly positioned about 120 degrees from the upright orientation 222 shown in FIG. 2. At this angle (or other selected downwardly sloping angles) the lid is enabled to automatically be unlatched through operation of the exemplary latch (as will be described below in more detail) to allow the contents of the cavity of the waste container to be unloaded and dumped out through the opening responsive to gravitational force.

Referring again to FIG. 1, the example apparatus 102 may include a latch mechanism 120 which is alternatively referred to herein as a latch. The apparatus also includes a striker 122. The example apparatus also includes an outside release mechanism 124. When the lid 106 is in a closed position relative to the bin 108, and the waste container is in the upright position shown in FIG. 2, the example latch mechanism is operative to lockingly hold the striker 122 in engagement therewith. When the latch and striker are in locked engagement, the lid is held in the closed position and is prevented from pivoting to its open position. To enable the lid to open, the example release mechanism 124 is configured to be manually operated by a user to actuate and move portions of the latch mechanism and enable the latch mechanism and the striker to disengage.

An example outside release mechanism includes a movable manually engageable element such as a knob 126. The knob is in operative connection with a base 128. The exemplary base has an outer shape that is compatible with the outer surface configuration of the lid 106. For example, as shown in FIG. 1, the lid 106 may slope downwardly to an end side of the lid opposite the hinge. The base 128 is configured to mount to such a sloped surface while orientating the knob, such that when the waste container is in the upright orientation an axis of rotation of the knob is substantially vertical.

However, it should be appreciated that in alternative embodiments, the base may be configured to have the knob in other angular orientations and the base may be adapted to mount to lids of configurations of waste containers or other receptacles with other slopes and surface designs. Also, in alternative embodiments of outer release mechanisms, rather than having a knob shape, the movable element may have the shape of a paddle, lever, button, handle, or any other configuration that is capable of being selectively manipulated by a user to actuate the latch mechanism.

As shown in FIG. 1, the latch mechanism 120 may be mounted in fixed operative connection with an inside surface 130 of the lid. When the lid is in the closed position, the inside surface of the lid faces inwardly toward the cavity 112. In this example, the outside release mechanism may be mounted in fixed operative connection with the outside surface 132 of the lid. Also, in this example, the striker 122 may be mounted in fixed operative connection an inside surface 134 of a wall 136 of the bin 108. However, it should be appreciated that in alternative embodiments, these elements may be mounted to the waste container in other orientations. For example, the release mechanism 124 and latch mechanism 120 may be configured to mount to the side wall 136 of the bin 108 while the striker 122 is mounted to the inside surface 130 of the lid. In order to mount these described elements to the waste container, the latch mechanism, outside release mechanism, may include threaded bores and/or apertures to accommodate the use of fasteners 140 such as bolts, screws, nuts (or any other type of structures, fasteners or other features that are operative to hold these elements in fixed connection with the waste container).

Figure 7:
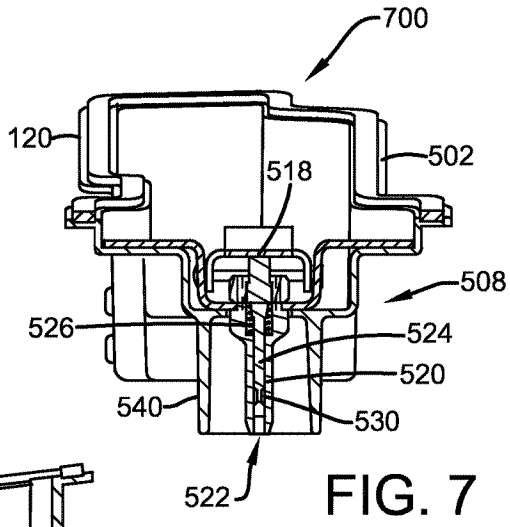
FIGS. 5-10 are side, top, and front views of internal elements of the latch apparatus in different angular orientations.
Figure 6:
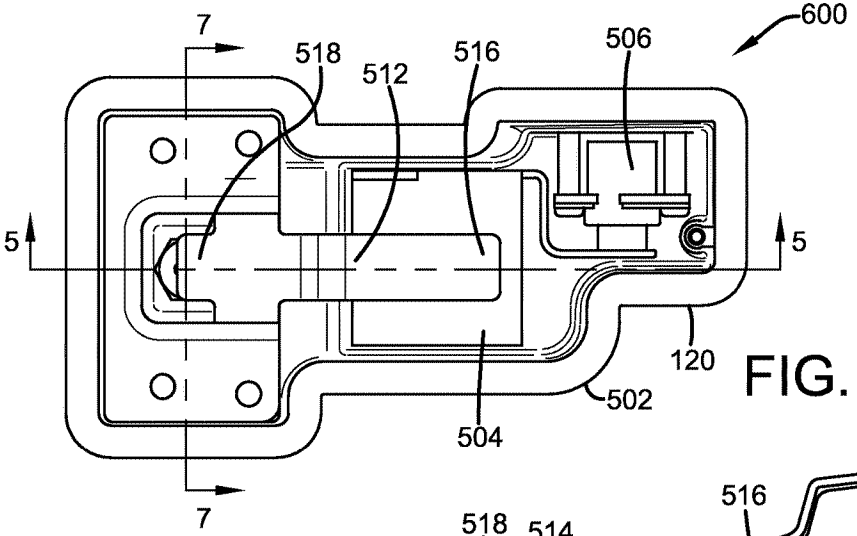
Figure 5:
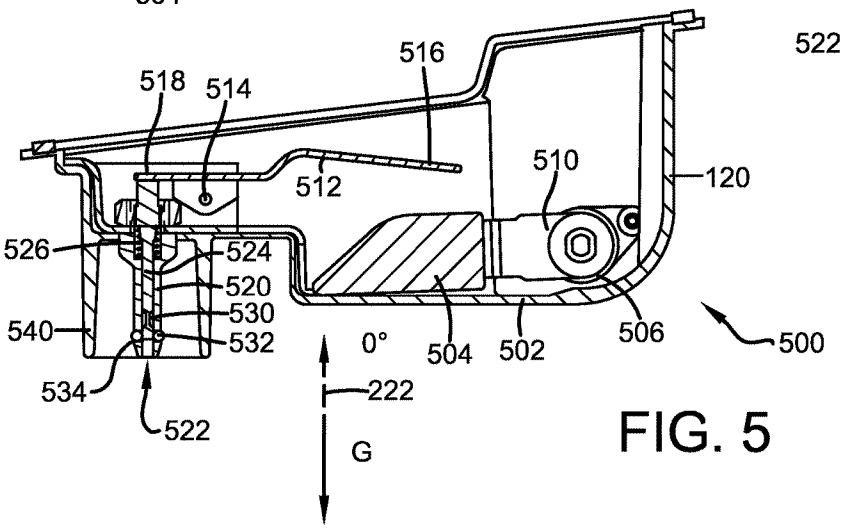

FIGS. 5-10 illustrate example operations of the latch 120. FIGS. 5, 6, and 7 are respectively a side cross-sectional view 500, a top view 600, and a front cross-sectional view 700 of the latch in a neutral configuration. Such a neutral configuration corresponds to an orientation of the internal elements of the latch when the example waste container to which it is mounted is in an upright (zero degree) orientation 222 with the opening extending in the horizontal direction and the lid closed (such as shown in FIG. 2). Also, it should be noted that the cross-sectional view of FIG. 5 is an opposite side view of the latch mechanism 120 shown in FIG. 1 with the section taken along line 5-5 in FIG. 6 in order to show internal elements more clearly. The latch is also shown without the outside release mechanism.

Figure 9:
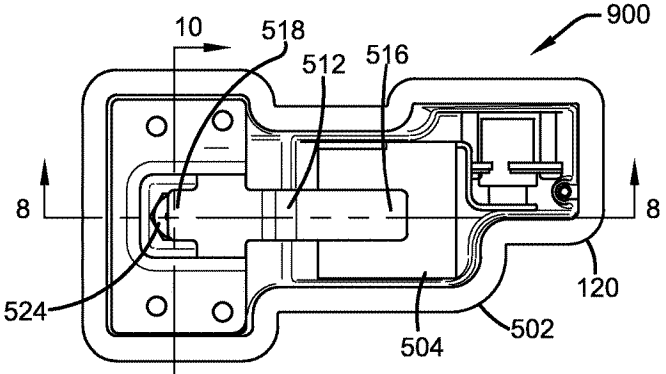
Figure 10:
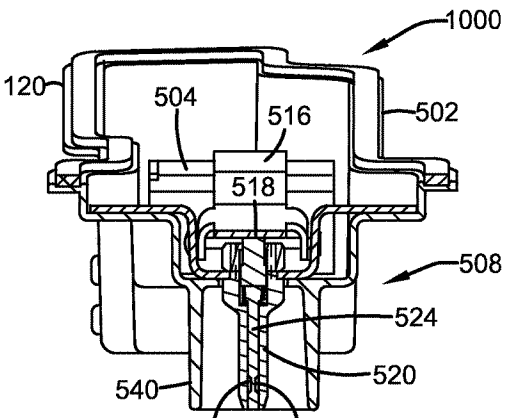
Figure 8:
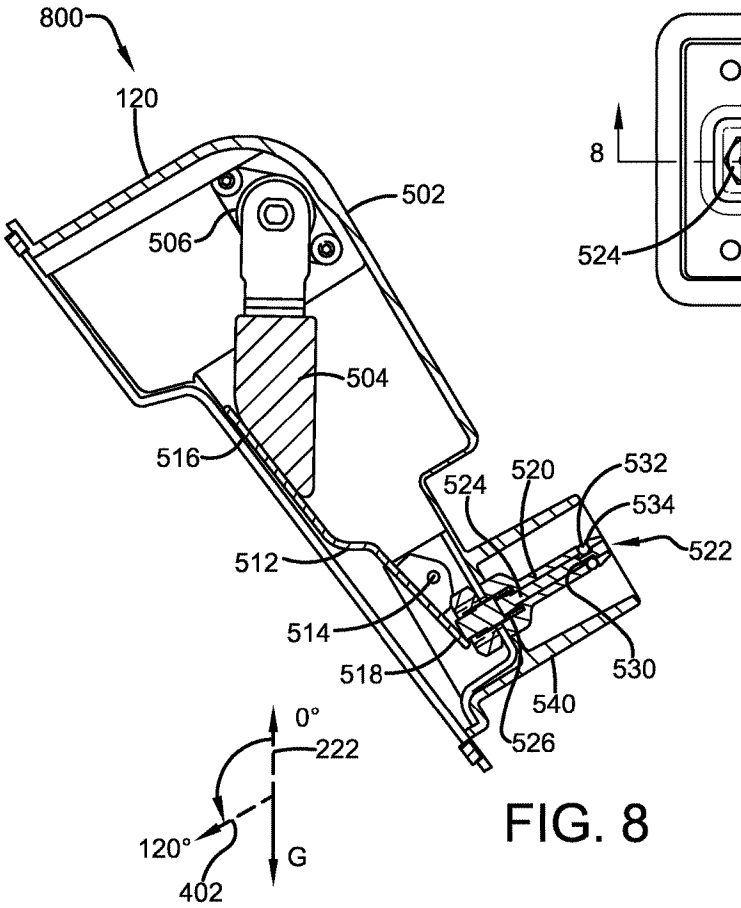

FIGS. 8, 9, and 10 are respectively a side cross-sectional view 800, a top view 900, and a front cross-sectional view 1000 of the latch in an internal release configuration. The internal release configuration corresponds to orientation of the internal elements of the example latch when the waste container to which it is mounted is rotated to the downwardly angled (about 120 degrees from upright) orientation 402 shown in FIG. 4 with the lid enabled to open (such as shown in phantom in FIG. 4). However, it should be appreciated that the cross-sectional view in FIG. 8 is shown from the opposite side of the latch 120 compared in FIG. 1 and FIG. 4. FIG. 8 also does not show the outside release mechanism. Thus the example latch 120 in FIG. 8 is shown rotated about 120 degrees from the position of the latch in the upright position of the example waste container.

With reference to FIGS. 5 and 6, the example latch 120 includes a receptacle which is also referred to herein as a housing 502. In the exemplary housing is a movably mounted release weight 504 and a damper 506. An engagement mechanism 508 is operative to engagingly hold and release the striker. In this example embodiment, the damper comprises a rotary damper including a shaft connected to a rotatable portion (i.e., a rotor) that is operative to pivot/rotate with respect to a stator portion (e.g., a stationary member, both the rotor and stator being within a housing of the damper). Such a rotary damper may include a viscous fluid therein and the rotor and stator may include blades or fins. As the rotor turns, resistance or shear force of the fluid acting between the stator and rotor is operative to resist relative movement of the rotor by the force acting to cause the shaft of the damper to turn.

In the example arrangement shown in FIG. 5, the release weight 504 is connected to the shaft of the damper via a damper lever 510. As will be described in more detail below, the damper is operative to slow (with respect to velocity) the rotation of the release weight 504 when the release weight is urged to rotate responsive to gravity or other forces such as impact or inertial forces. An example of a rotary damper for use with the described latch mechanism may include the rotary dampers made by ACE Stoßdämpfer GmbH, of Germany having a capability of providing a damping (resistance) torque from between 0.1 to 2.0 Ncm at a nominal rotational speed of 20 rpm at 23° C. However, it should also be appreciated that alternative embodiments may use rotary dampers with other torque damping characteristics depending on the size and arrangement of the desired release weight. Further, alternative embodiments may use dampers that reduce or limit the velocity of a release weight or other movable member that controls the locked or unlocked condition of a latch via other devices (e.g. torsion springs, a viscous fluid, weights, gears, magnets, fluid pressure, etc.).

As shown in FIGS. 5 and 6, the example latch mechanism 120 may also include a latch lever 512. The latch lever may be configured to pivot with respect to the housing 502 at a pivot point 514. The latch lever may include a first end portion 516 and a second end portion 518 located on opposite sides of the pivot point 514. The first end portion 516 is disposed further from the pivot than the second end portion 518. When the latch mechanism 120 is in the neutral orientation shown in FIGS. 5-7, the release weight is configured to rest in a first position adjacent a lower portion of the housing such that the weight is spaced apart from the first end 516 of the latch lever.

Also as shown in FIGS. 5 and 7, the engagement mechanism 508 includes a latch shaft 520. The latch shaft 520 includes a cavity 522 axially extending therein. A latch pin 524 extends in the cavity and is configured to be movable in the axial direction relative to the latch shaft. The engagement mechanism includes a spring 526. Spring 526 is a compression spring that is configured to bias the latch pin 524 to move in the cavity 522 toward a retracted position (shown in FIGS. 5 and 7) relative to the shaft from an extended position (which will be described below with respect to FIGS. 8-10). The extended position of the example arrangement corresponds to the latch pin extending further axially outward in the latch shaft compared to the distance the latch pin extends in the latch shaft when in the retracted position.

In the example arrangement, the second end portion 518 of the latch lever is operative to contact an inward end of the latch pin 524. Thus, when the spring 526 has urged the latch pin 524 to its retracted position, the latch pin is in engagement with the second end 518 of the latch lever 512 in the first angular orientation of the latch lever shown in FIG. 5. In some arrangements the latch lever 512 may be restricted from free rotational movement or otherwise configured to remain in engagement with the latch pin, while in other arrangements the latch lever may be free to move about the pivot such that the first end 516 may move to engage the release weight 504 when the weight is in the position shown in FIG. 5.

As shown in FIGS. 5 and 7, the exemplary latch pin 524 includes at least one annular side channel 530. In the exemplary arrangement, the annular side channels extend in an outer surface of the latch pin. While in the exemplary arrangement a single annular side channel is shown, in other arrangements multiple axially spaced channels may be used. Further in other arrangements, the side channels may include discrete hemispherical pockets or other recess structures that extend in the latch pin. Of course these structures are exemplary and in other arrangements, other approaches may be used.

In the exemplary arrangement, the latch shaft includes a plurality of apertures therein. In the exemplary arrangement the plurality of apertures are generally circular and extend radially between the outside surface of the latch shaft 520 and the inside surface bounding axial cavity 522.

In the exemplary arrangement a plurality of projecting members are movably positioned in the apertures 534. In the exemplary arrangement the projecting members include a plurality of spherical members which are also referred to herein as balls 532. In the exemplary configuration, the balls are sized so that they can extend radially outward beyond the outer surface of the latch shaft through the apertures but cannot pass through the apertures so as to disengage from the latch shaft. The balls of the exemplary embodiment are also sized so that when the side channel in the surface of the latch pin is positioned in adjacent relation to the balls, the balls are enabled to radially retract inwardly so that the balls do not extend substantially beyond the outer surface of the latch shaft.

In the exemplary embodiment when the latch pin 524 is in the retracted position shown in FIG. 5, the outer surface of the latch pin in an area disposed away from the annular channel is in engaged relation with the balls 532. In this configuration shown in FIG. 5, the balls extend radially outward beyond the outer surface of the latch shaft. As later discussed in greater detail, the outward protrusion of the balls which serve as projecting members enables the latch to lockingly engage with the striker 122. Further in the exemplary arrangement when the latch shaft is in an extended position, the annular channel 530 moves in generally axially aligned relation with the balls 532. This enables the balls to move radially inward such that they no longer substantially protrude beyond the outer surface of the latch shaft. This enables the latch shaft to disengage from the striker.

It should be understood, however, that this configuration is exemplary of structures that may be utilized for selectively latchingly engaging a latch and a striker. For example, other structures such as tabs, fingers or other types of movable projecting members may be movable so as to selectively lockingly engage a striker in a latched condition. Such structures may be relatively movable so as to enable disengagement with the striker responsive to operation of the components of the latch. Further it should be appreciated that while the exemplary arrangement includes projecting members that extend outwardly from a locked shaft and are enabled to be moved inwardly during disengagement with a striker, other arrangements may utilize configurations where projecting members movable mounted on the striker may engage recesses or other features on a locked shaft so as to hold the latch and striker in engagement. In such arrangements for example, the latch may be operative to include components that selectively displace projecting members on a striker from engagement with the lock shaft so as to enable disengagement of the latch and striker. Of course such structures are exemplary and in other embodiments, other approaches may be used.

Figure 12:
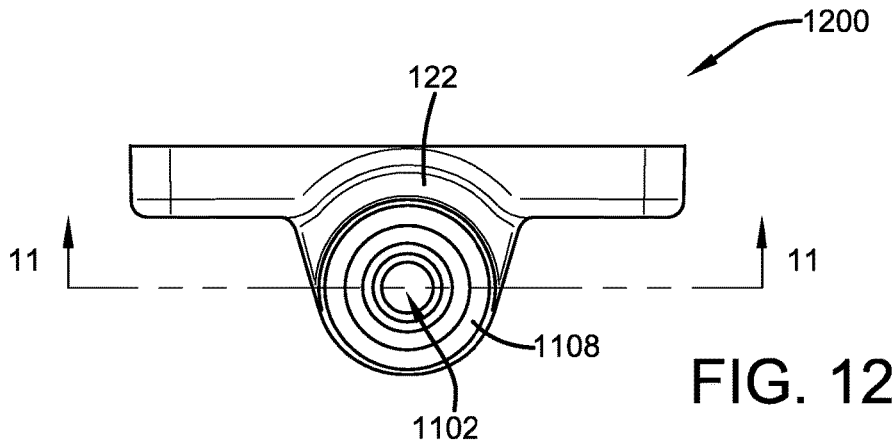
FIGS. 11-12 are cross-sectional and top views of an exemplary striker assembly.
Figure 11:
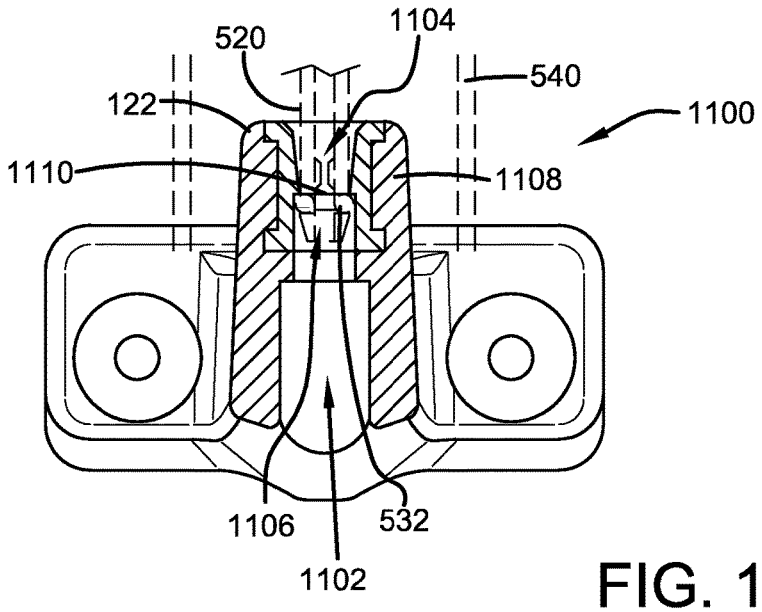

FIGS. 11 and 12 are respectively a cross-sectional side view 1100 and a top view 1200 of an example striker 122. FIG. 11 shows the exemplary previously described latch shaft 520 (in phantom) extending into an aperture 1102 of the striker 122. The aperture includes an outer portion referred to herein as an upper portion 1104 that is inwardly tapered. The inwardly tapered configuration facilitates engagement of the latch shaft therein. FIG. 11 illustrates the radially outward protrusion of the balls 532 when the latch pin is in its extended position with respect to the latch shaft. In this example, the aperture in cross section includes an annular step such that the upper portion 1104 of the aperture 1102 in the striker 122 at its inward end has a smaller diameter than the diameter of a relatively lower portion 1106 of the aperture. The maximum distance 1108 between the outer surfaces of the balls 1102 when projecting radially outward on opposed sides of the latch shaft is greater than the diameter of the upper portion 1104 1106 of the aperture. Thus, when the balls 532 extend radially outward from the latch shaft 520, the balls can engage the step surface 1110 between the upper and lower portions of the aperture so as to prevent the latch shaft from being pulled out of the aperture of the striker.

Referring back to FIGS. 5 and 7, in an example embodiment, the engagement mechanism includes an annular guard 540 that extends in surrounding relationship and radially spaced away from at least portions of the latch shaft 520. As shown in FIG. 11, an outward portion shown as an upper portion of the exemplary striker 1108 that inwardly bounds the upper portion 1104 of the aperture 1105 has an outer barrel or cylindrical shape that is configured to extend inside the guard 540 when the latch shaft 520 extends in the aperture 1102. The relatively larger diameter of the guard 540 of the example arrangement may function to prevent the latch shaft 520 from puncturing objects (including portions of a person's body) that may come in contact with the described engagement mechanism.

Referring again to FIGS. 8-10, as discussed previously, these Figures show the latch in an internal release configuration when the waste container to which the latch is mounted is rotated to the downwardly angled (120 degree) dump orientation (such as shown in FIG. 4). This is the orientation in which the lid can open to enable the contents of the container cavity to be dumped into a refuse holding receptacle of a garbage truck or other structure. In this orientation, the release weight has moved from the first position (shown in FIG. 5) responsive to the change in direction of gravitational force G acting on the release weight, to the second position shown in FIG. 8. In the second position, the release weight 504 is configured to come in contact with the first end portion 516 of the latch lever 512 to cause the latch lever to rotate to the second angular orientation shown in FIG. 8.

Also, in this orientation of the release weight 504 and the latch lever 512 the second end portion 518 of the latch lever 512 has caused the latch pin 524 to move against the biasing force of the spring to move from its retracted position (shown in FIG. 5) to the extended position in the latch shaft (shown in FIGS. 8 and 10). In the extended position of the latch pin 522, the channel 530 becomes radially aligned with the balls 532. As a result, the balls 532 are enabled to slide radially inward into the channel and thus either not protrude outward from or at least protrude less from the outer surface of the latch shaft 520. This arrangement enables the latch shaft to disengage from the striker because the balls no longer engage the step surface 1110. This enables the latch to move out of the aperture of the striker. This enables the lid to open so that the content of the bin can be dumped out.

It should be appreciated that this described latch mechanism (when in an orientation of about 120 degrees such as shown in FIGS. 8-10) is configured to have a release weight with a sufficient mass to press on the latch lever with sufficient force to overcome the opposing biasing force of the spring 526. This enables the latch pin to move the necessary distance to the extended position.

However, at other lower sloped downward angular orientations of the latch mechanism (such as orientations between 90 and 95 degrees relative to the neutral orientation/upright configuration of the container represented in FIG. 5), the exemplary configuration and mass of the release weight and the arrangement of the spring and other described elements, may not be operative to overcome the force of the spring in order to move the latch pin to the extended position in the latch shaft.

Consequently, when the exemplary waste container is merely knocked over on its side (such as shown in FIG. 3) or tilted downwardly slightly (e.g. 90-95 degree rotations), the latch in this example would not be operative to operate responsive to gravity to cause disengagement the latch shaft from the aperture of the striker. Rather, not until the waste container is further rotated from the orientation shown in FIG. 3 to closer to the orientation shown in FIG. 4, and positioned in such orientation for a sufficient period of time to enable the damper to allow the weight to move the necessary amount would the described latch mechanism operate to disengage the latch shaft from the aperture of the striker and permit the lid to open.

With this described design, the latch mechanism permits the lid to automatically open when a lifter mechanism of a garbage truck (or other device) lifts and rotates the waste container such that the opening to the cavity thereof has a downward angular orientation greater than that shown in FIG. 3 (e.g., greater than 90 degrees relative to the upright orientation shown in FIG. 2). Whereas if an animal such as a raccoon merely knocks the waste container on its side (as shown in FIG. 3) the lid of the exemplary waste container will remain latched and closed.

It should also be noted that the exemplary release weight and latch lever configuration (shown in FIG. 5) as well as the damping effect of the damper, is operative to substantially increase the amount of time it takes for the release weight (when biased by gravity to rotate) to cause the latch lever to rotate and the latch pin to move to its retracted position. This delay is operative to prevent the latch from disengaging from a striker responsive to jarring forces when an animal or forces of nature (e.g. wind) tip a waste container on its side (at 90 degrees) or cause a container to be thrown about and/or the container to incur a jarring impact force.

Thus in example embodiments, a damper is an element operative to substantially slow or otherwise control the speed of movement of a release weight or other member that is being urged to move via gravity to cause a latch to change from a latched to an unlatched condition. For example, a damper may correspond to an element that slows movement of the release weight in the housing such that an amount of time for the release weight to move responsive to gravity from the first position to the second position is at least twice an amount of time the release weight would move responsive to gravity from the first position to the second position in the housing absent the effect of the damper on the release weight.

In the examples described herein that use a rotary damper, such a rotary damper may increase the amount of time that the release weight takes to move from the first position to the second position (when the latch mechanism/waste container is in about the 120 degree position) by more than two times, compared to an alternative but comparable arrangement without the rotary damper. Such an alternative but comparable arrangement without a damper would correspond to the release weight being merely connected to a pivot shaft and lever of similar geometry as the damper shaft/damper arm geometry, but that imparts an insignificant amount of friction/resistance to movement of the release weight responsive to gravity from the first position to the second position at the same orientation of about 120 degrees from the upright orientation.

As an example, the release weight may take 2 seconds to travel from the first position to the second position at the described 120 degree orientation when using a damper. But without a damper in an alternative comparable arrangement, the release weight may take a fraction of a second to move from the first position to the second position at the described 120 degree orientation. In example embodiments described herein the release weight may be configured to take at between 1 and 10 seconds to travel from the first position to the second position at the 120 degree orientation when using a damper. However it should be appreciated that in other embodiments the release weight may be configured to take other amounts of time to travel from the first position to the second position at the 120 degree orientation when using a damper.

However, as previously discussed, example embodiments of latches and striker arrangements may operate using other types of dampers which operate using different principles than that discussed in connection with the exemplary arrangement to control the speed of movement of a release weight or similar actuation mechanism. Further, other exemplary arrangements may utilize movable actuation devices as alternatives to a movable weight that moves responsive to a change in the relative direction of gravitational force acting on a latch in order to change a latch between latched and unlatched conditions. It should be appreciated that the principles discussed herein of requiring that a waste container be in a desired orientation that corresponds to that utilized to dump the contents of the container, and that the container be in that orientation for a sufficient period of time so as to indicate that the container is being positioned in that orientation by a proper device or mechanism for dumping the container, can be implemented through numerous different structures and mechanisms that may be devised based on the teachings herein. Further, it should be appreciated that while the exemplary embodiment is configured to enable the waste container to have its lid automatically open when the container is at about 120 degrees from the upright position at which the container is filled and usually stored, other latch mechanisms may be configured to have the lid automatically open with the container in other configurations. This might include, for example, having the lid open when the container is in an orientation that is higher than 120 degrees such as 150-180 degrees. Alternatively other arrangements such as where containers are configured to hold and dump primarily a liquid or other waste may not require the lid or other closure member to remain closed to an angle of 120 degrees. For some such waste containers it may be suitable to enable the lid or other closure member to open at a lesser angle.

Further, the exemplary arrangement has been discussed in connection with a waste container that has a single hinged lid configuration and which includes a latch and striker arrangement that is engaged on a side opposed of the hinge configuration. While this is a useful configuration, other example embodiments may employ different types of container and lid configurations. For example, multiple separably movable lids, covers or closure members may be utilized in connection with some such containers. Such arrangements may utilize latches and striker configurations which are suitable for the opening and closing movements of the particular lid members. Further, while the exemplary arrangements have been described as including a hinged type lid configuration, other arrangements may provide for lids or closure members to be separated in other ways from the opening to the container. This may include, for example, relatively sliding closure members as well as closure members that are separated entirely from the bin structure of the container. The principles described herein may find applicability in such other material holding arrangements which differ from the example embodiments described herein.

As discussed previously with respect to FIG. 1, example embodiments of the described apparatus may include an outside release mechanism 124. Such a release mechanism enables a user to actuate the latch to disengage from the striker when the waste container is in an upright orientation (such as shown in FIG. 2). This may be done to place items in the cavity of the bin or to remove items therefrom.

Figure 15:
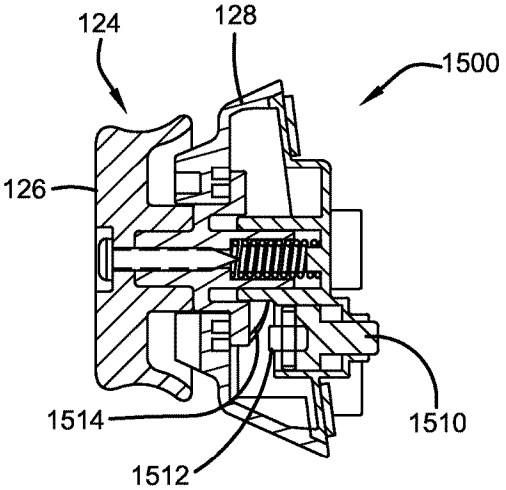
FIGS. 13-21 are cross-sectional and top views of an exemplary release mechanism for a latch apparatus and the elements of the release mechanism.
Figure 14:
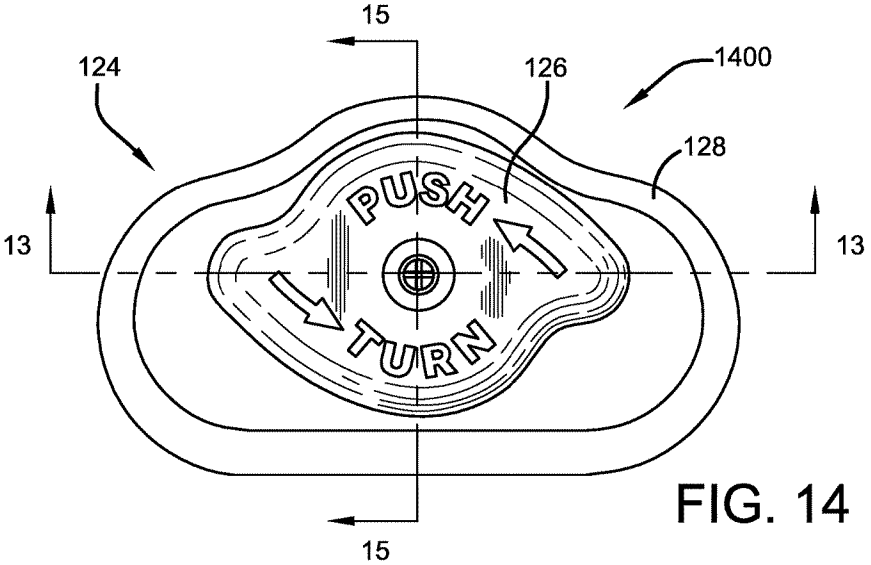
Figure 13:
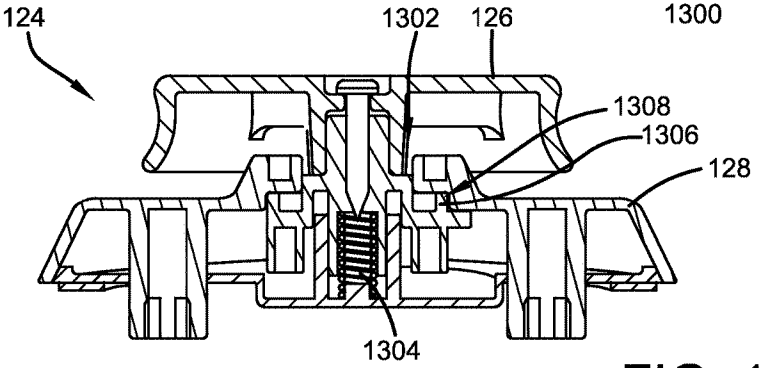

FIGS. 13-15 illustrate example operations of the release mechanism 124. FIGS. 13, 14, and 15 are respectively a front cross-sectional view 1300, a top view 1400, and a side cross-sectional view 1500 of the release mechanism in a neutral configuration. As used herein, the neutral configuration corresponds to an orientation of the elements of the release mechanism when the release mechanism is not being manipulated by a human to actuate the latch to enable the latch to be disengaged from the striker.

Figure 18:
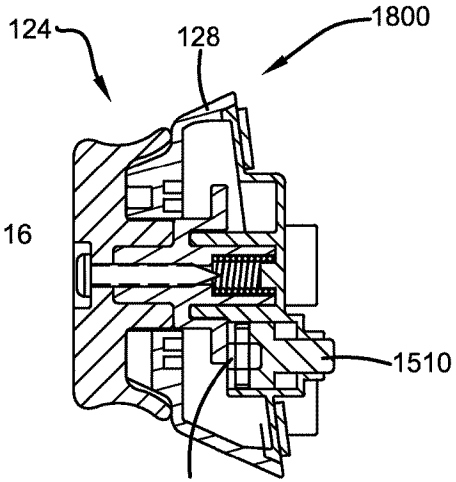
Figure 17:
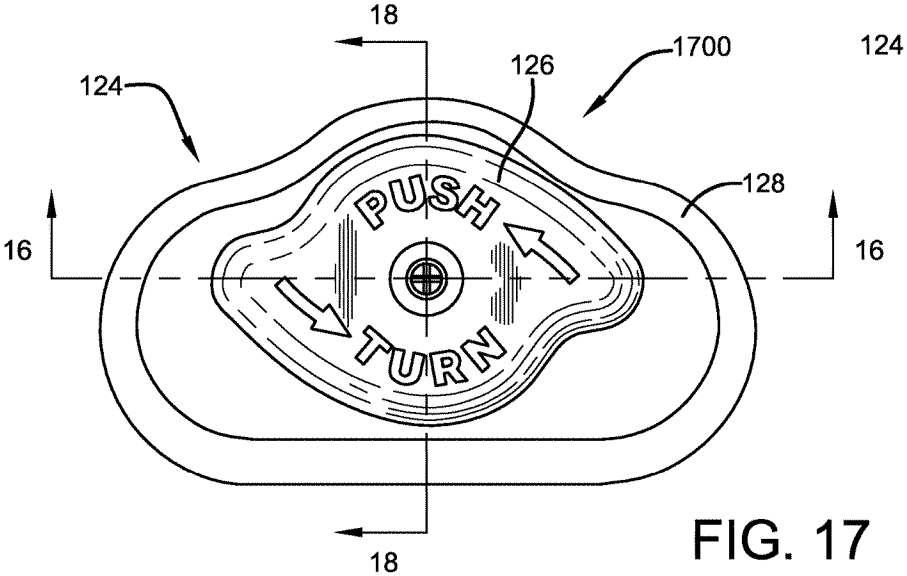
Figure 16:
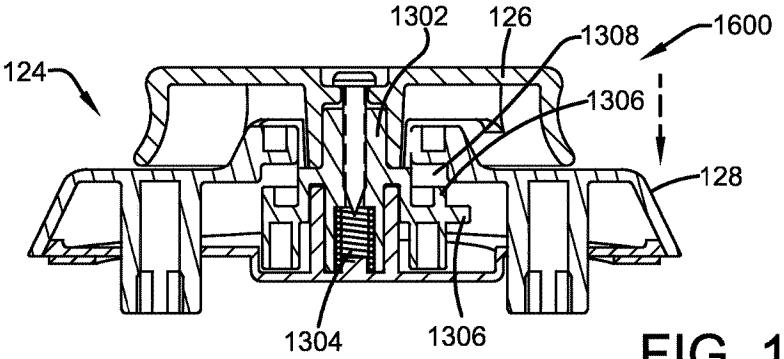

FIGS. 16-18 are respectively a front cross-sectional view 1600, a top view 1700 and a side cross-sectional view 1800 of the release mechanism in an intermediate release configuration after the knob 126 has been pushed downwardly by a human (to be relatively more compact in combination with the base 128).

Figure 21:
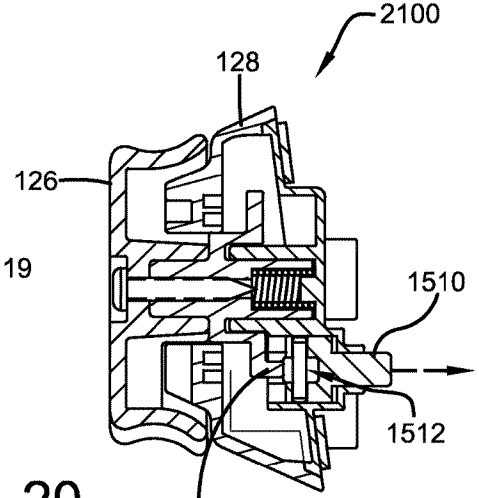
Figure 20:
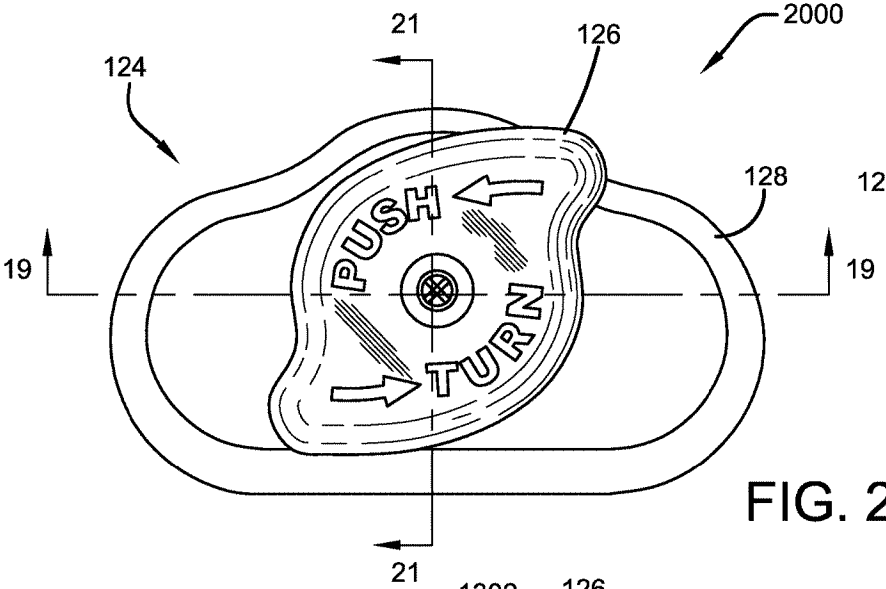
Figure 19:
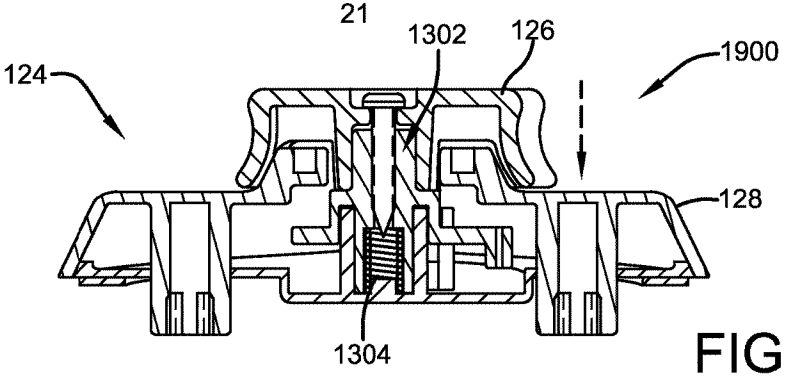

FIGS. 19-21 are respectively a front cross-sectional view 1900, a top view 2000, and a side cross-sectional view 2100 of the release mechanism in a release configuration when the knob 126 is both pushed downwardly and is rotated with respect to the base 128. As used herein the release configuration corresponds to an orientation of the elements of the release mechanism when the release mechanism is operative to actuate the latch mechanism to enable the latch to be disengaged from the striker.

Referring to FIG. 13, the knob 126 of the example release mechanism 124 is fastened to a shaft 1302 that extends in a cavity in the base 128. A spring 1304 is arranged to act between portions of the shaft 1302 and the base 128 so as to urge the shaft 1302 and knob 126 to an extended position outwardly relative to the base 124. When the knob is in the extended position, projections 1306 in engaged relation with the shaft 1302 may be positioned in apertures 1308 in a wall portion of the release base 128 to prevent the knob from rotating relative to the base.

When the knob 126 (and shaft) is moved axially to the inward retracted position relative to the base 128 (such as shown in FIGS. 16-18), the projections 1306 in the shaft member 1302 are be positioned inwardly the apertures 1308 in the wall of the base. Thus in the intermediate orientation shown in FIGS. 16-18, the knob is enabled to either move axially back to the extended position (via the urging forces of the spring) or be rotated while in the retracted position.

As shown in FIGS. 15 and 18, the exemplary base 128 includes a release pin 1510. The release pin includes a first internal end that is in operative connection with a roller 1512, or other driven surface. In addition, as shown in FIG. 15, the shaft 1302 includes an angled cam surface 1514. When the knob is moved axially inward to the retracted position, the cam surface 1514 moves downwardly so that a narrower portion of the cam surface is adjacent the roller 1512 associated with the release pin.

When the knob is rotated with respect to the base (to the position shown in FIGS. 19-21), the relatively taller portions of the cam surface 1514 are operative to slideably engage the roller 1512 of the release pin 1510 and cause the release pin to move outward relative to the base from the retracted position (shown in FIGS. 15 and 18) to an the extended position (shown in FIG. 21). In the outward position the release pin 1510 is configured to engage and move the second end 518 of the latch lever 512 to unlatch the latch.

Figure 23:
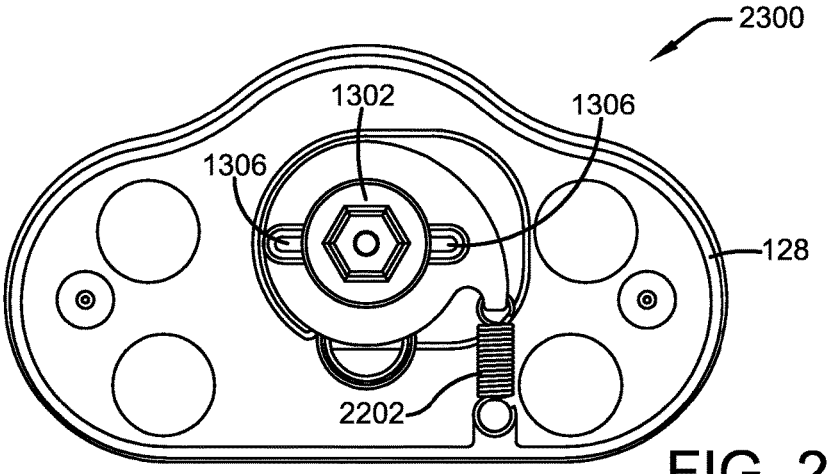
FIGS. 22-23 are side and top views of internal portions of the exemplary release mechanism.
Figure 22:
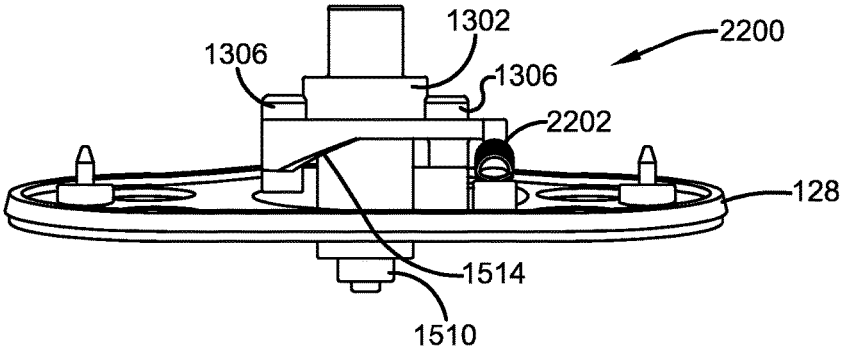

FIGS. 22 and 23 are respectively a side view 2200 and top view 2300 of the internal structures of the release mechanism including the base 128 and shaft 1302 without the knob and an outer housing of the base. As shown in these views, the exemplary release mechanism includes a tension spring 2202 operatively connected between the shaft and the base. The spring is operative to resist turning of the knob and shaft from the first angular position shown in FIGS. 13-15 to the second angular position shown in FIG. 19-21. Consequently, when the user lets go of the knob, this spring 2202 is operative to automatically rotate the shaft and knob to the position shown in FIGS. 16-18. When the knob and shaft are in the position shown in FIGS. 16-18, the previously described compression spring 1304 is operative to urge the shaft and knob to move from the inward retracted position back to the outward extended position. Thus, when a user is done operating the release mechanism in the manner described, the release mechanism is operative to automatically re-configure itself back to the neutral orientation shown in FIGS. 13-15.

In example embodiments, the described components of the latch mechanism, release mechanism, and striker may be comprised of plastics (e.g., polycarbonate, ABS, PVC or other plastic materials), metals (stainless steel, aluminum, tin or other metals), and/or any other materials that are operative to form the described shapes and be capable of carrying out the functions described herein. Further, these described elements may be mounted together with fasteners such as screws, bolts, adhesives, or any other fastening or bonding system applicable to the type of materials being assembled. In addition, it should be appreciated that the housings may include gaskets, o-rings, and/or other elements to increase the weather/water resistance of the described mechanisms.

Figure 24:
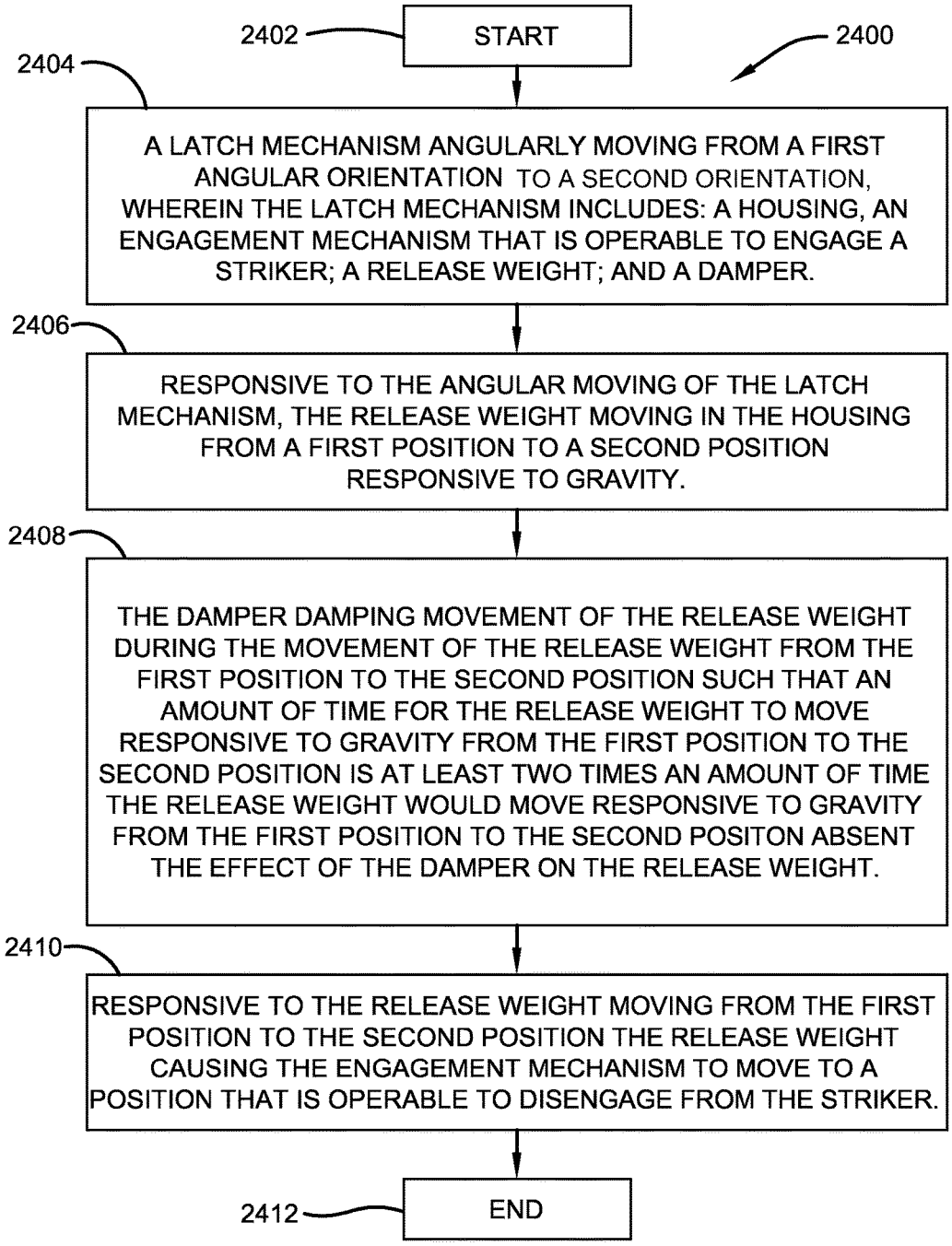
FIG. 24 illustrates an example methodology for operation of an example latch apparatus of a waste container.

With reference now to FIG. 24, an example methodology is illustrated and described. While the methodologies are described as being a series of steps that are performed in a sequence, it is to be understood that the methodologies are not limited by the order of the sequence. For instance, some acts may occur in a different order than what is described herein. In addition, an act may occur concurrently with another act. Furthermore, in some instances, not all acts may be required to implement a methodology described herein.

Referring now to FIG. 24, a methodology 2400 that facilitates operating the previously described latch apparatus is illustrated. The methodology 2400 begins at 2402, and at step 2404 includes a latch mechanism angularly moving from a first angular orientation to a second angular orientation. As described previously, such a latch may include: a housing; an engagement mechanism that is operable to engage with a striker; a release weight; and a damper. At step 2406, the method may include responsive to step 2404 the release weight moving in the housing from a first position to a second position responsive to gravity.

Also at step 2408, the exemplary method may include the damper damping movement of the release weight during step 2406 such that an amount of time for the release weight to move responsive to gravity from the first position to the second position is at least twice an amount of time the release weight would move responsive to gravity from the first position to the second position absent the effect of the damper on the release weight. In addition, the example method includes a step 2410 in which responsive to step 2406 the release weight causes the engagement mechanism to move to a position that is operable to disengage from the striker. At step 2412 this described method ends.

In this described method, the latch is configured to prevent the release weight from causing the engagement mechanism of the latch to disengage from the striker, unless the latch is in a range of angular orientations that is disposed more than 90 degrees in any direction (e.g., clockwise, counterclockwise, and sideways) from the first angular orientation, which corresponds to an upright orientation of the waste container.

For example, in step 2404 the threshold angular orientation from when the latch mechanism changes from a state of not enabling the engagement mechanism of the latch to disengage from the striker to a state of causing the engagement mechanism to disengage from the striker may be set at between 90-95 degrees in one example embodiment, at between 95-100 in another example embodiment, at between 100-110 degrees in another example embodiment, at between 110-120 degrees in a further embodiment, higher than 120 degrees in another example embodiment or any other angle or range of angles that are all greater than 90 degrees.

It is noted that several examples have been provided for purposes of explanation. These examples are not to be construed as limiting the hereto-appended claims. Additionally, it may be recognized that the examples provided herein may be permutated while still falling under the scope of the claims.

Further, it should be appreciated that while the exemplary embodiments described herein relate to waste containers and particular configurations of the exemplary waste containers, the structures and principles of the exemplary embodiments may be applied to other configurations of waste containers or other types of containment devices, closure structures or latching arrangements in other fields of use.

Thus the exemplary embodiments described herein achieve improved operation, eliminate difficulties encountered in the use of prior devices, systems and methods and attain the useful results described herein.

In the foregoing description certain terms have been used for brevity, clarity and understanding. However, no unnecessary limitations are to be implied therefrom because such terms are used for descriptive purposes and are intended to be broadly construed. Moreover, the descriptions and illustrations herein are by way of examples and the inventive aspects are not limited to the features shown and described.

Further, having described the features, discoveries and principles of the exemplary embodiments, the manner in which they are constructed and operated and the advantages and useful results attained, the new and useful structures, devices, elements, arrangements, parts, combinations, systems, equipment, operations, methods, processes and relationships are set forth in the appended claims.

We claim:

1. Apparatus comprising:

a latch, wherein the latch is configured to be in attached operative connection with a waste container including a bin and a lid, wherein the bin bounds a waste storage cavity and includes an opening to the waste storage cavity, wherein the lid is movable relative to the bin between an open position and a closed position in which the lid opens and closes the opening, respectively, wherein the latch includes:

a movable projection, wherein the movable projection is movable between a latched position in which the movable projection is configured to hold the lid in the closed position, and an unlatched position wherein the lid is enabled to be moved to the open position, a spring, a weight, wherein the weight is movable between a first weight position and a second weight position responsive to gravitational force and changes in orientation of the latch, a pin, wherein the pin is movably mounted relative to the latch and wherein the pin is in operative connection with the movable projection, the spring, and the weight, wherein when the weight is not in the second weight position, the spring is operative to bias the pin in toward a first pin position, wherein in the first pin position the pin is operative to cause the movable projection to be held in the latched position, wherein the latch is configured such that when the weight is in the second weight position, the weight is operative to cause the pin to be disposed from the first pin position against the biasing force of the spring to a second pin position, wherein in the second pin position the movable projection is enabled to move to the unlatched position, wherein the latch is configured such that when the opening is in an angular orientation of less than 90 degrees from horizontal, the weight is disposed away from the second weight position, and wherein when the opening is in a dump angular orientation that is greater than 90 degrees from horizontal and such that the opening is directed downward, the weight is in the second weight position, whereby the movable projection is movable from the latched position to the unlatched position, the lid is enabled to move from the closed position to the open position, and the contents of the waste storage cavity can be dumped therefrom, a damper, wherein the damper is in operative connection with the weight, wherein the damper is configured to slow movement of the weight between the first weight position and the second weight position, wherein the damper is operative to prevent the weight from moving to the second weight position responsive to jarring forces when the opening is in an angular orientation range below the dump angular orientation.

2. The apparatus according to claim 1, wherein the damper is operative to control movement of the weight in the housing such that an amount of time for the weight to move responsive to gravity from the first weight position to the second weight position is at least twice an amount of time the weight would take to move responsive to gravity from the first weight position to the second weight position in the housing absent the effect of the damper on the weight.

3. The apparatus according to claim 2, wherein when the latch is rotated so the opening is moved from horizontal to at least 120 degrees from horizontal, the amount of time for the weight to move responsive to gravity from the first weight position to the second weight position is at least 1 second.

4. The apparatus according to claim 3, wherein the latch is configured to prevent the weight from enabling the movable projection to move to the unlatched position in a range of angular orientations of the latch in which the opening is not greater than 90 degrees from horizontal.

5. The apparatus according to claim 1, and further comprising:

the waste container and a striker, wherein the striker is in operative attached connection with the lid, wherein in the latched position the movable projection is in engagement with the striker and wherein such engagement holds the lid in the closed position, wherein the relatively movable lid is configured to pivot with respect to the bin between the open position and the closed position, wherein the bin includes an inside wall surface, wherein in the open position of the relatively movable lid, the waste storage cavity is accessible from outside the bin through the opening, wherein in the closed position of the relatively movable lid, the relatively movable lid is operative to cover the opening to the waste storage cavity, wherein when the relatively movable lid is in the closed position, the relatively movable lid includes an inside surface facing the waste storage cavity and the relatively movable lid includes an opposed outside surface, wherein the latch is in operative attached connection with the inside surface of the relatively movable lid, wherein the striker is in operative attached connection with the inside wall surface of the bin, wherein when the relatively movable lid is in the closed position, the movable projection is operative to engage the striker in holding relation, and wherein when the relatively movable lid is in the closed position, rotation of a release knob is operative to cause the movable projection to enable disengagement of the latch and the striker.

6. The apparatus according to claim 1 and further including a manually actuatable release mechanism, wherein the manually actuatable release mechanism is in operative connection with the movable projection, wherein manual actuation of the manually actuatable release mechanism is operative to enable the movable projection to move to the unlatched position when the latch is not in the predetermined range of angular orientations.

7. The apparatus according to claim 6, wherein the manually actuatable release mechanism includes a knob, wherein the knob is configured to be axially and rotationally movable, wherein the manual actuation of the manually actuatable release mechanism to enable movement of the movable projection to the unlatched position includes rotational movement of the knob while the knob is displaced axially inward from an initial knob position.

8. The apparatus according to claim 1, and further comprising:

a knob, wherein the knob is in operative connection with the latch, wherein the knob is configured to be rotatably and axially movable relative to an axis, a cam and a release member, wherein the knob is in operative connection with the cam and the release member, wherein axial and rotational movement of the knob is operative to cause the cam to cause the release member to move, wherein movement of the release member is operative to cause the pin to be disposed from the first pin position to the second pin position.

9. The apparatus according to claim 8,
and further comprising:
a lever, wherein the lever is rotationally movably mounted relative to the latch about a pivot,
wherein the lever includes a first end, wherein the first end is disposed from the pivot in a first direction, and a second end wherein the second end is disposed from the pivot in an opposed direction,
wherein the second end is in operative connection with the pin,
wherein the first end is in operative engagement with the weight in the second weight position,
wherein the first end engageable with the weight is disposed from the pivot a greater distance than the second end.

10. The apparatus according to claim 9,
and further comprising:
an outward biasing spring, wherein the outward biasing spring is operative to bias the knob axially outward relative to the latch to an outward position,
a rotational biasing spring wherein the rotational biasing spring is operative to bias the knob toward a first rotational position, and wherein the knob is configured such that when the knob is in the outward position, the knob is prevented from being rotated relative to the latch,
wherein movement of the knob axially inward and rotation of the knob from the first rotational position is operative to cause movement of the release member,
wherein movement of the release member is operative to cause the release member to be in operative engagement with the second end of the lever.

11. Apparatus comprising:
a latch including:
a housing, wherein the housing is configured for operative attachment to one of a bin or a relatively movable lid of a waste container, wherein the other of the bin or the relatively movable lid includes a striker,
a latch shaft, wherein the latch shaft includes an outer wall and an axially extending cavity within the latch shaft,
a plurality of projecting members in operative connection with the latch shaft, wherein the plurality of projecting members are each radially movable between a retracted member position and an extended member position with respect to the outer wall of the latch shaft, wherein in the extended member position the plurality of projecting members are engageable with the striker,
a latch pin, wherein a portion of the latch pin movably extends in the axially extending cavity within the latch shaft, wherein the latch pin is movable between an inward pin position and an outward pin position,
a spring in operative connection with the latch pin, wherein the spring is operative to bias the latch pin toward the inward pin position, wherein in the inward pin position the latch pin is operative to cause each projecting member of the plurality of projecting members to be in the extended member position,
a release weight, wherein the release weight is configured to move responsive to gravity in the housing between a first weight position and a second weight position,
a release lever, wherein the release lever is mounted in operative connection with the housing and is configured to operatively engage the latch pin,
a damper, wherein the damper is in operative connection with the release weight, wherein the damper substantially slows movement of the release weight in the housing from the first weight position to the second weight position when the latch is in a predetermined range of angular orientations,
wherein in the first weight position of the release weight, the release weight does not cause a force to be applied to the latch pin sufficient to move the latch pin from the inward pin position,
wherein in the second weight position of the release weight, the release weight is in operative connection with the release lever and is operative to apply sufficient force to cause the release lever to move the latch pin in the axially extending cavity from the inward pin position to the outward pin position, wherein in the outward pin position, each projecting member of the plurality of projecting members is enabled to move from the extended member position to the retracted member position,
wherein when the latch is in the predetermined range of angular orientations each of the plurality of projecting members are movable to the retracted member position and are enabled to disengage from the striker.

12. The apparatus according to claim 11,
and further comprising:
a guard wall, wherein the guard wall extends in surrounding relation relative to at least portions of the latch shaft, wherein the guard wall is configured to be radially spaced away from the plurality of projecting members when each projecting member is in the extended member position.

13. The apparatus according to claim 11,
and further comprising:
a damper lever, wherein a first end portion of the damper lever is in operative connection with the damper, wherein a second opposed end portion of the damper lever is in operative connection with the release weight, wherein the damper is operative to slow rotational movement of the damper lever caused by gravity urging the release weight to move away from the first weight position toward the second weight position.

14. The apparatus according to claim 13,
wherein the damper includes a rotary damper that is operative to produce a damping torque on a rotary member rotating at 20 rpm at 23° C. of between 0.1 to 2.0 Ncm.

15. The apparatus according to claim 11,
and further comprising:
a release mechanism, wherein the release mechanism includes:
a release knob, a release base, and a release pin,
wherein the release knob is operative to move between an extended knob position and a retracted knob position relative to the release base,
wherein the release knob in the retracted knob position is enabled to rotate relative to the release base,
wherein the release knob is in fixed operative connection with a cam surface,
wherein when the release knob is in the retracted knob position and is rotated in a first angular direction, the cam surface is operative to urge the release pin to move from a retracted release pin position relative to the release base to an extended release pin position relative to the release base, wherein the release pin in the extended release pin position is operative to cause the latch pin to be in the outward pin position, whereby the latch is enabled to be disengaged from the striker.

16. The apparatus according to claim 15, wherein the release mechanism is configured such that when the release knob is in the extended knob position, the release knob is not rotatable in a manner that causes the release pin to move to the extended release pin position.

17. The apparatus according to claim 16, and further comprising:

the waste container and the striker, wherein the relatively movable lid is configured to pivot with respect to the bin between an open position and a closed position, wherein the bin includes a bin cavity and an opening into the bin cavity, wherein the bin cavity is bounded by an inside wall surface, wherein in the open position of the relatively movable lid, the bin cavity is accessible from outside the bin through the opening, wherein in the closed position of the relatively movable lid, the relatively movable lid is operative to cover the opening to the bin cavity, wherein when the relatively movable lid is in the closed position, the relatively movable lid includes an inside surface facing the bin cavity and the relatively movable lid includes an opposed outside surface, wherein the latch mechanism is in operative connection with the inside surface of the relatively movable lid, wherein the release mechanism is in operative connection with the outside surface of the relatively movable lid, wherein the striker is in operative connection with the inside wall surface of the bin, wherein the lid includes an aperture therethrough, wherein when the relatively movable lid is in the closed position, the projecting members are operative to holdingly engage with the striker, wherein when the relatively movable lid is in the closed position and the release knob is in the retracted knob position and is rotated in the first angular direction, the release pin is operative to move relative to the aperture in the lid and urge the release lever to rotate and urge the latch pin to move from the inward pin position to the outward pin position relative to the latch shaft.

18. Apparatus comprising:

a latch, wherein the latch is configured to be in attached operative connection with a waste container including a bin and a lid, wherein the bin bounds a waste storage cavity and includes an opening to the waste storage cavity, wherein the lid is movable relative to the bin between an open position and a closed position in which the lid opens and closes the opening, respectively, wherein the latch includes:

a movable projection, wherein the movable projection is movable between a latched position in which the movable projection is configured to hold the lid in the closed position, and an unlatched position wherein the lid is enabled to be moved to the open position, an axially elongated latch pin, wherein the latch pin is movably mounted in operatively supported connection with the latch and is movable in the axial direction, wherein the latch pin is axially movable between a first pin position and a second pin position, wherein in the first pin position the latch pin operatively holds the movable projection in the latched position, and in the second position the movable projection is enabled to move to the unlatched position, a weight, wherein the weight is movable relative to the latch between a first weight position and a second weight position responsive to gravitational force and changes in orientation of the latch, wherein the weight is in operative connection with the movable projection via the latch pin, wherein the latch is configured such that the latch pin is moved responsive to the weight such that when the weight is in the second weight position, the latch pin is the second pin position and the movable projection is enabled to move from the latched position to the unlatched position, and wherein when the weight is not in the second weight position the latch pin is in the first pin position and the movable projection is caused to be in the latched position, wherein the latch is configured such that when the opening is in an angular orientation of less than 90 degrees from horizontal, the weight is disposed away from the second weight position, and wherein when the opening is in a dump angular orientation that is greater than 90 degrees from horizontal and such that the opening is directed downward, the weight is in the second weight position, whereby the movable projection is movable from the latched position to the unlatched position, the lid is enabled to move from the closed position to the open position, and the contents of the waste storage cavity can be dumped therefrom, a damper, wherein the damper is in operative connection with the weight and it is configured to slow movement of the weight between the first weight position and the second weight position, wherein the damper is operative to prevent the weight from moving to the second weight position responsive to jarring forces when the opening is in an angular range below the dump angular orientation.

19. The apparatus according to claim 18, and further including:

a knob, wherein the knob is movably mounted in operative connection with the latch, wherein the knob is configured to be rotatably and axially movable relative to an axis, wherein the latch is configured such that combined axial movement and rotational movement of the knob is operative to enable the movable projection to be movable from the latched position to the unlatched position regardless of angular orientation of the latch.

20. The apparatus according to claim 18, and further comprising:

a lever, wherein the lever is rotationally movably mounted relative to the latch about a pivot, wherein the lever includes a first end, wherein the first end is disposed from the pivot in a first direction, and a second end, wherein the second end is disposed from the pivot in an opposed direction, wherein the second end is in operative connection with the movable projection, wherein the first end is in operative engagement with the weight in the second weight position, and wherein the first end is disposed from the pivot a greater distance than the second end.

* * * * *